US010526736B2

(12) United States Patent
Shirotani

(10) Patent No.: US 10,526,736 B2
(45) Date of Patent: Jan. 7, 2020

(54) INSULATING NONWOVEN FABRIC AND METHOD FOR MANUFACTURING THE SAME, INSULATING MATERIAL

(71) Applicant: KURARAY CO., LTD., Kurashiki-shi (JP)

(72) Inventor: Yasuhiro Shirotani, Saijo (JP)

(73) Assignee: KURARAY CO., LTD., Kurashiki-shi (JP)

( * ) Notice: Subject to any disclaimer, the term of this patent is extended or adjusted under 35 U.S.C. 154(b) by 291 days.

(21) Appl. No.: 15/129,254

(22) PCT Filed: Mar. 24, 2015

(86) PCT No.: PCT/JP2015/058842
§ 371 (c)(1),
(2) Date: Sep. 26, 2016

(87) PCT Pub. No.: WO2015/146953
PCT Pub. Date: Oct. 1, 2015

(65) Prior Publication Data

US 2018/0187352 A1 Jul. 5, 2018

(30) Foreign Application Priority Data

Mar. 27, 2014 (JP) ..... 2014-066207

(51) Int. Cl.
*D04H 3/009* (2012.01)
*D04H 3/16* (2006.01)

(52) U.S. Cl.
CPC ..... *D04H 3/009* (2013.01); *D04H 3/16* (2013.01); *D10B 2401/04* (2013.01)

(58) Field of Classification Search
CPC ..... D04H 1/4326; D04H 1/54; D04H 1/56; D04H 3/009; D04H 3/16; D10B 2401/04; D01F 6/74
See application file for complete search history.

(56) References Cited

U.S. PATENT DOCUMENTS

2006/0011063 A1* 1/2006 Zhou ..... B01D 53/228 96/10
2006/0240242 A1 10/2006 Raghavendran et al.
2012/0015184 A1* 1/2012 Endo ..... D01F 6/74 428/364
2013/0123437 A1 5/2013 Endo et al.
2013/0255899 A1 10/2013 Krahn et al.
2015/0167199 A1 6/2015 Endo et al.
2016/0145782 A1 5/2016 Sasaki et al.

FOREIGN PATENT DOCUMENTS

| | | | |
|---|---|---|---|
| CN | 101134380 | A | 3/2008 |
| CN | 102362021 | A | 2/2012 |
| EP | 2 384 803 | A1 | 11/2011 |
| EP | 3 015 586 | A1 | 5/2016 |
| JP | 1-132898 | A | 5/1989 |
| JP | 5-311594 | A | 11/1993 |
| JP | 2011-127252 | A | 6/2011 |
| JP | 2012-41644 | A | 3/2012 |
| JP | 2015-514165 | A | 5/2015 |
| WO | 2012/014713 | A1 | 2/2012 |
| WO | 2013/148989 | A1 | 10/2013 |
| WO | 2014/208671 | A1 | 12/2014 |

OTHER PUBLICATIONS

Extended European Search Report dated Aug. 22, 2017 in Patent Application No. 15768402.8.
International Search Report dated Jun. 23, 2015 in PCT/JP2015/058842 filed Mar. 24, 2015.
Combined Office Action and Search Report dated Mar. 5, 2018 in Chinese Patent Application No. 201580015893.X with partial English translation and English translation of categories of cited documents, citing documents AO AQ therein, 12 pages.
Office Action dated Dec. 11, 2018 in Japanese Patent Application No. 2016-510367 citing document AO therein, 4 pages (with English translation).

* cited by examiner

*Primary Examiner* — Arti Singh-Pandey
(74) *Attorney, Agent, or Firm* — Oblon, McClelland, Maier & Neustadt, L.L.P.

(57) ABSTRACT

Provided are a nonwoven fabric mainly composed of amorphous polyetherimide having a melt viscosity at 330° C. of 100 to 3000 Pa·s, and satisfying conditions of: 1) an average fiber diameter of 0.5 to 5 μm; 2) an air permeability of more than or equal to 20 seconds/100 mL; and 3) a withstand voltage of more than or equal to 15 kV/mm, an insulating material using the nonwoven fabric, and a method for manufacturing the nonwoven fabric including continuously treating fibers between a pair of rolls at a temperature of 150 to 300° C. and a linear pressure of 100 to 500 kg/cm.

7 Claims, No Drawings

INSULATING NONWOVEN FABRIC AND METHOD FOR MANUFACTURING THE SAME, INSULATING MATERIAL

TECHNICAL FIELD

The present invention relates to a nonwoven fabric having flame retardancy and a high electrical insulation (insulating nonwoven fabric) and a method for manufacturing the same, and an insulating material using the nonwoven fabric.

BACKGROUND ART

Nonwoven fabrics having flame retardancy are employed extremely effectively in the fields of general industrial materials, electric and electronic materials, medical materials, agricultural materials, optical materials, materials for aircrafts, automobiles, and ships, apparel and the like, in particular in applications in which there are many opportunities of exposure to high-temperature environments.

In recent years, a nonwoven fabric using split fibers and a nonwoven fabric made of extra-fine fibers manufactured with a flash spinning method, a melt blown method, or the like have been developed, and are used for filter application and the like. However, such a nonwoven fabric made of extra-fine fibers is mainly composed of a resin such as polypropylene or polyethylene terephthalate, and hence flame retardancy and heat resistance have been insufficient and use thereof at a high temperature has not been suitable.

Although some techniques for manufacturing a nonwoven fabric using fibers made of a flame retardant polymer have been attempted, such an unfavorable condition as melt fracture or high melt tension takes place in an attempt to obtain extra-fine fibers, and it has been difficult to obtain a nonwoven fabric made of flame retardant extra-fine fibers with good productivity.

The applicant has proposed, as a nonwoven fabric made of polyetherimide (hereinafter also referred to as "PEI") fibers having flame retardancy, a nonwoven fabric mainly composed of amorphous PEI fibers having a specific structure and three-dimensionally entangled with one another, for example in Japanese Patent Laying-Open No. 2012-41644 (PTD 1). Regarding amorphous PEI fibers, the applicant has also proposed heat-resistant and flame-retardant paper having not only excellent flame retardancy and heat resistance but also low equilibrium moisture regain in Japanese Patent Laying-Open No. 2011-127252 (PTD 2), and a heat fusion fiber, a fiber structure body, and a heat-resistant molded body having excellent heat resistance, flame retardancy, and dimensional stability in International Publication No. 2012/014713 (PTD 3).

Thus, amorphous PEI fibers are not only high in melting point and excellent in heat resistance owing to its molecular frame but also excellent in flame retardancy. However, examples in PTD 1 disclose only a nonwoven fabric made with a spun lace method, which has a relatively high fineness with a fiber diameter being 2.2 dtex (corresponding to 15 μm). Although a nonwoven fabric made of amorphous PEI fibers and having denseness increased enough to have electrical insulation has not been known, if it is possible to provide a nonwoven fabric which has electrical insulation in addition to flame retardancy, such a nonwoven fabric is expected to be applicable to wider applications, such as the field of electrical insulating paper.

CITATION LIST

Patent Document

PTD 1: Japanese Patent Laying-Open No. 2012-41644
PTD 2: Japanese Patent Laying-Open No. 2011-127252
PTD 3: International Publication No. 2012/014713

SUMMARY OF INVENTION

Technical Problem

An object of the present invention is to provide a novel nonwoven fabric having not only flame retardancy but also electrical insulation, and a method for manufacturing the same.

Solution to Problem

An nonwoven fabric of the present invention is mainly composed of amorphous polyetherimide having a melt viscosity at 330° C. of 100 to 3000 Pa·s, and satisfies conditions of: 1) an average fiber diameter of 0.5 to 5 μm; 2) an air permeability of more than or equal to 20 seconds/100 mL; and 3) a withstand voltage of more than or equal to 15 kV/mm.

Preferably, the nonwoven fabric of the present invention has a vertical strength of more than or equal to 15 N/15 mm.

Preferably, the nonwoven fabric of the present invention has a density within a range of 0.65 to 1.25 g/cm$^3$.

The present invention also provides an insulating material made of the nonwoven fabric of the present invention described above.

The present invention also provides a method for manufacturing the nonwoven fabric of the present invention described above, including continuously treating fibers between rolls arranged to face each other, at a temperature of 150 to 300° C. and a linear pressure of 100 to 500 kg/cm.

Preferably, in the method for manufacturing the nonwoven fabric of the present invention, the rolls arranged to face each other are an elastic roll whose surface has a Shore D hardness of 85 to 95° and a metal roll.

Preferably, in the method for manufacturing the nonwoven fabric of the present invention, the continuously treated fibers are manufactured with a melt blown method or a spunbond method.

Advantageous Effects of Invention

The present invention provides a nonwoven fabric having flame retardancy and also having denseness increased enough to have electrical insulation (insulating nonwoven fabric), and a method for manufacturing the same. Such a nonwoven fabric of the present invention can be suitably used as an insulating material.

DESCRIPTION OF EMBODIMENTS

A nonwoven fabric of the present invention is mainly composed of amorphous polyetherimide (PEI) having a melt viscosity at 330° C. of 100 to 3000 Pa·s. Amorphous PEI employed in the present invention refers to a polymer containing an aliphatic, alicyclic, or aromatic ether unit and cyclic imide as a repeating unit, and it is not particularly limited as long as it has amorphousness and melt formability. Here, being "amorphous" can be confirmed by subjecting obtained fibers to a differential scanning calorimetry system (DSC), increasing a temperature at a rate of 10° C./minute in nitrogen, and checking whether or not there is an endothermic peak. When the endothermic peak is very broad and no clear endothermic peak can be determined, such a case indicates a level which does not give rise to a problem in actual use, and determination as amorphous may substantially be made. As long as effects of the present invention are not diminished, a main chain of amorphous PEI may contain cyclic imide or a structural unit other than ether bond, such as an aliphatic, alicyclic, or aromatic ester unit or an oxycarbonyl unit.

A polymer expressed with a general formula below is suitably employed as amorphous PEI. In the formula, R1 represents a divalent aromatic residue having 6 to 30 carbon atoms, and R2 represents a divalent organic group selected from the group consisting of a divalent aromatic residue having 6 to 30 carbon atoms, an alkylene group having 2 to 20 carbon atoms, a cycloalkylene group having 2 to 20 carbon atoms, and a polydiorganosiloxane group chain-terminated with an alkylene group having 2 to 8 carbon atoms.

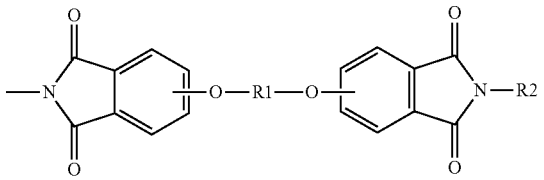

Amorphous PEI should have a melt viscosity at 330° C. of 100 to 3000 Pa·s. When the melt viscosity of amorphous PEI at 330° C. is less than 100 Pa·s, fiber dust or resin particles called shots which are produced due to failure in formation of fibers may often be generated during spinning. When the melt viscosity of amorphous PEI at 330° C. is more than 3000 Pa·s, a trouble may occur during polymerization or granulation, such as difficulty in obtaining extra-fine fibers and generation of oligomers during polymerization. The melt viscosity at 330° C. is preferably 200 to 2700 Pa·s, and more preferably 300 to 2500 Pa·s.

Preferably, amorphous PEI has a glass transition temperature of more than or equal to 200° C. When the glass transition temperature is less than 200° C., heat resistance of an obtained nonwoven fabric may be poor. As amorphous PEI has a higher glass transition temperature, a nonwoven fabric better in heat resistance is obtained, which is preferable. However, when the glass transition temperature is too high, a fusion temperature also becomes high during fusion, and a polymer may be decomposed during fusion. Amorphous PEI has a glass transition temperature of preferably 200 to 230° C. and further preferably 205 to 220° C.

A molecular weight of amorphous PEI is not particularly limited. However, in consideration of mechanical characteristics, dimensional stability, or processability of obtained fibers or nonwoven fabric, a weight average molecular weight (Mw) is preferably 1000 to 80000. Use of amorphous PEI having a high molecular weight is preferred because of superiority in strength of fibers and heat resistance. From the viewpoints of costs for manufacturing a resin, costs for producing fibers, and the like, the weight average molecular weight is preferably 2000 to 50000, and more preferably 3000 to 40000.

In the present invention, a condensate of 2,2-bis[4-(2,3-dicarboxyphenoxy)phenyl]propane dianhydride and m-phenylenediamine or p-phenylenediamine which mainly has a structural unit expressed with a formula below is preferably employed as a PEI resin, from the viewpoints of amorphousness, melt formability, and cost. This PEI is commercially available from SABIC Innovative Plastics under the trademark ULTEM.

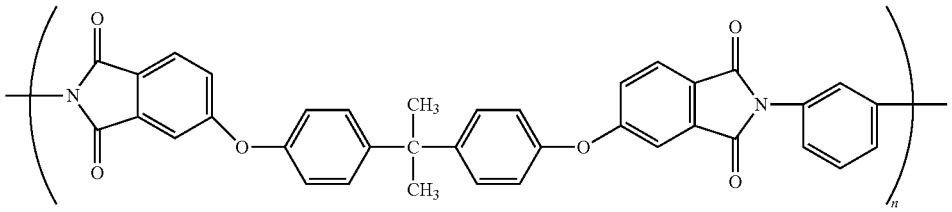

Amorphous PEI fibers forming the nonwoven fabric of the present invention may contain an antioxidant, an antistatic agent, a radical inhibitor, a delusting agent, an ultraviolet absorbing agent, a flame retardant, an inorganic substance, or the like, as long as the effects of the present invention are not diminished. Specific examples of such an inorganic substance include carbon nanotube, fullerene, silicate such as talc, wollastonite, zeolite, sericite, mica, kaolin, clay, pyrophyllite, silica, bentonite, and alumina silicate, metal oxide such as silicon oxide, magnesium oxide, alumina, zirconium oxide, titanium oxide, and iron oxide, carbonate such as calcium carbonate, magnesium carbonate, and dolomite, sulfate such as calcium sulfate and barium sulfate, hydroxide such as calcium hydroxide, magnesium hydroxide, and aluminum hydroxide, glass beads, glass flakes, glass powder, ceramic beads, boron nitride, silicon carbide, carbon black, graphite, and the like. Furthermore, for the purpose of improvement in resistance to hydrolysis of fibers, a terminal sequestering agent such as a mono- or di-epoxy compound, a mono- or poly-carbodiimide compound, a mono- or di-oxazoline compound, or a mono- or di-azirine compound may be contained.

The nonwoven fabric of the present invention has an average fiber diameter within a range of 0.5 to 5 μm. When the average fiber diameter is less than 0.5 μm, it is necessary to reduce a discharge amount, which reduces productivity. In addition, when the average fiber diameter is less than 0.5 μm, a discharge pressure becomes unstable, and thread breakage or polymer lumps are often generated, which makes formation of a web difficult. Further, when the average fiber diameter is more than 5 μm, there is such a defect that it is not possible to achieve denseness enough to allow the nonwoven fabric to have electrical insulation. In particular, for the reason of achieving both production stability and denseness, the average fiber diameter of the nonwoven fabric of the present invention is preferably within a range of 1 to 4 μm, and particularly preferably within a range of 2 to 3 μm.

Further, the nonwoven fabric of the present invention has an air permeability of more than or equal to 20 seconds/100 mL, and has a high air permeability which cannot be quantified by "air permeance". When the air permeability is less than 20 seconds/100 mL, there is such a defect that the nonwoven fabric cannot have electrical insulation. In particular, for the reason of providing a high insulation performance, the air permeability is preferably more than or equal to 25 seconds/100 mL, and particularly preferably more than or equal to 30 seconds/100 mL. In addition, it is preferable for the nonwoven fabric of the present invention to have a higher air permeability, and the upper limit value thereof is not particularly limited, but it is less than or equal to 300 seconds/100 mL.

Further, the nonwoven fabric of the present invention has a withstand voltage of more than or equal to 15 kV/mm, and thus has a high electrical insulation (insulating nonwoven fabric). In particular, for the reason of obtaining reliable insulating paper, the withstand voltage is preferably more than or equal to 20 kV/mm, more preferably more than or equal to 30 kV/mm, further preferably more than or equal to 35 kV/mm, and particularly preferably more than or equal to 45 kV/mm. In addition, it is preferable for the nonwoven fabric of the present invention to have a higher withstand voltage, and the upper limit value thereof is not particularly limited, but it is less than or equal to 200 kV/mm.

Further, the nonwoven fabric of the present invention preferably has a vertical strength (strength in a vertical direction (a direction of flow in manufacturing the nonwoven fabric)) of more than or equal to 15 N/15 mm, although not particularly limited. When the vertical strength is less than 15 N/15 mm, the nonwoven fabric may tear during a turning work process in a case where it is used as an insulating material for a coil, a cable, or the like. In particular, from the viewpoint of obtaining high stability during the work process, the vertical strength is more preferably more than or equal to 20 N/15 mm, and particularly preferably more than or equal to 25 N/15 mm. In addition, it is preferable for the nonwoven fabric of the present invention to have a higher vertical strength, and the upper limit value thereof is not particularly limited, but it is less than or equal to 100 N/15 mm.

The nonwoven fabric of the present invention has a density preferably within a range of 0.65 to 1.25 g/cm$^3$, and more preferably within a range of 0.70 to 1.20 g/cm$^3$. Although the nonwoven fabric of the present invention has such a density that reflects the internal structure of the nonwoven fabric, and there have been cases where such a density makes control of insulation difficult, the nonwoven fabric has the air permeability described above and thereby a nonwoven fabric having a desired electrical insulation can be achieved.

Although the thickness of the nonwoven fabric of the present invention is not particularly limited, it is preferably within a range of 10 to 1000 μm, more preferably within a range of 15 to 500 μm, and particularly preferably within a range of 20 to 200 μm. When the thickness of the nonwoven fabric is less than 10 μm, there is a tendency that a high insulation performance cannot be obtained due to the presence of holes penetrating in a thickness direction. Further, when the thickness of the nonwoven fabric is more than 1000 μm, its use is restricted due to limitation on thickness (upper limit) in a case where the nonwoven fabric is used as an insulating material for electronic devices which are getting smaller in size and thickness, and the like.

Although the basis weight of the nonwoven fabric of the present invention is not particularly limited, it is preferably within a range of 10 to 1000 g/m$^2$, more preferably within a range of 15 to 500 g/m$^2$, and particularly preferably within a range of 20 to 200 g/m$^2$. When the basis weight of the nonwoven fabric is less than 10 g/m$^2$, strength may become low and break during a process may be likely. Further, a basis weight of the nonwoven fabric exceeding 1000 g/m$^2$ is not preferred from the viewpoint of productivity.

The nonwoven fabric of the present invention as described above achieves both excellent flame retardancy and excellent electrical insulation, and can be expected to be applicable to wide applications, including the field of electrical insulating paper. In addition, the present invention also provides an insulating material made of the nonwoven fabric of the present invention as described above.

The nonwoven fabric of the present invention as described above can be suitably manufactured by continuously treating fibers between rolls arranged to face each other, at a temperature of 150 to 300° C. and a linear pressure of 100 to 500 kg/cm. The present invention also provides a method for manufacturing the nonwoven fabric as described above. It should be noted that, in the method for manufacturing the nonwoven fabric of the present invention, it is only necessary that two rolls are arranged to face each other (in a pair), and a plurality of such pairs of rolls may be employed.

In the method for manufacturing the nonwoven fabric of the present invention, the continuously treated fibers are preferably manufactured with a melt blown method or a spunbond method. This provides advantages that a nonwoven fabric made of extra-fine fibers can be manufactured relatively easily, and that a solvent is not required during spinning and thus influence on the environment can be minimized. In addition, in the present invention, the method of manufacturing fibers is not limited to the methods described above, and extra-fine fibers may be manufactured with a known technique such as ESP or flash spinning.

In the case of the melt blown method, a conventionally known melt blown apparatus can be employed as a spinning apparatus, and spinning is preferably carried out under such conditions as a spinning temperature of 300 to 500° C., a hot air temperature (a primary air temperature) of 300 to 500° C., and an amount of air of 5 to 25 Nm$^3$ per 1 m of nozzle length.

In the case of the spunbond method, a conventionally known spunbond apparatus can be employed as a spinning apparatus, and spinning is preferably carried out under such conditions as a spinning temperature of 300 to 500° C., a hot air temperature (a temperature of air for drawing) of 300 to 500° C., and airstream for drawing of 500 to 5000 m/minute.

In the method for manufacturing the nonwoven fabric of the present invention, the obtained extra-fine fibers are hydroentangled (three-dimensionally entangled) with a spun lace method, and are subjected to heating and pressurizing treatment (calendering) under specific conditions as described above. Thereby, the nonwoven fabric of the present invention achieving both excellent flame retardancy and excellent electrical insulation can be suitably manufactured.

In the method for manufacturing the nonwoven fabric of the present invention, the continuous treatment using the rolls arranged to face each other described above is performed at a temperature within the range of 150 to 300° C. When the temperature is less than 150° C., there is a tendency that heating for welding fibers is insufficient and the nonwoven fabric cannot be compressed and densified. Further, when the temperature is more than 300° C., there is a tendency that the nonwoven fabric is strongly welded onto the rolls and cannot be removed from the rolls (the nonwoven fabric breaks). It should be noted that, for the reason of achieving both compression/denseness and production stability, the continuous treatment using the rolls arranged to face each other is preferably performed at a temperature within a range of 170 to 280° C., and particularly preferably performed at a temperature within a range of 190 to 260° C.

In the method for manufacturing the nonwoven fabric of the present invention, the continuous treatment using the rolls arranged to face each other described above is performed at a linear pressure of 100 to 500 kg/cm. When the linear pressure is less than 100 kg/cm, there is a tendency that heating for welding fibers is insufficient and the nonwoven fabric cannot be compressed and densified. Further, when the linear pressure is more than 500 kg/cm, there is a tendency that the nonwoven fabric is broken. It should be noted that, from the viewpoint of achieving both compression/denseness and production stability, the continuous treatment using the rolls arranged to face each other is preferably performed at a linear pressure within a range of 130 to 400 kg/cm, and particularly preferably performed at a linear pressure within a range of 160 to 330 kg/cm.

The rolls arranged to face each other employed in the method for manufacturing the nonwoven fabric of the present invention may be a combination of metal rolls. The type of metal for each metal roll is not particularly limited as long as it is made of a metal, and conventionally-known, appropriate metal rolls can be used. For example, metal rolls made of SUS can be suitably used. Even when using a combination of such metal rolls, a nonwoven fabric having a high electrical insulation described above can be manufactured, for the reason of employing a high basis weight of more than or equal to 100 g/m$^2$, for example.

In the method for manufacturing the nonwoven fabric of the present invention, the rolls arranged to face each other are preferably a combination of an elastic roll whose surface has a Shore D hardness of 85 to 95° (preferably 87 to 95°, particularly preferably 91 to 94°) and a metal roll. By using a combination of an elastic roll having an adequate hardness (high hardness) and a metal roll, a nonwoven fabric having a fully reduced thickness can be manufactured. In addition, since the rolls have good followability to the nonwoven fabric, uniform processing can be performed, and a nonwoven fabric having a high electrical insulation as described above is obtained more suitably.

When an elastic roll whose surface has a Shore D hardness of more than 95° is used in combination with a metal roll, or when metal rolls are used in combination, the rolls can fully compress the nonwoven fabric and reduce the thickness itself, but they have a too high surface hardness and have poor followability to the nonwoven fabric. Accordingly, there is a possibility that unevenness (irregularities or texture) of the nonwoven fabric may remain and only a nonwoven fabric having a low electrical insulation can be obtained.

Further, when an elastic roll whose surface has a Shore D hardness of less than 85° is used in combination with a metal roll, there is a possibility that the rolls cannot fully compress the nonwoven fabric and cannot increase denseness enough to allow the nonwoven fabric to have electrical insulation. In addition, also in the case where the elastic roll has a too low surface hardness, there is a possibility that unevenness of the nonwoven fabric described above remains without being eliminated and only a nonwoven fabric having a low electrical insulation can be obtained, as in the case of the elastic roll whose surface has a Shore D hardness of more than 95°.

The material for the elastic roll employed in the method for manufacturing the nonwoven fabric of the present invention is not particularly limited as long as the surface of the elastic roll has a Shore D hardness within the above range, and a conventionally known, appropriate elastic roll made of rubber, resin, paper, cotton, aramid fibers, or the like can be employed. As such an elastic roll, a commercially available product may be employed, and specifically, an elastic roll such as a resin elastic roll manufactured by Yuri Roll Co., Ltd. can be suitably employed.

EXAMPLES

Hereinafter, the present invention will be specifically described with reference to Examples. It should be noted that the present invention is not limited thereto.

[Melt Viscosity]

Melt viscosity was measured under conditions of a temperature of 330° C. and a shear velocity r=1200 sec$^{-1}$, with the use of Capilograph 1B of Toyo Seiki Seisaku-Sho, Ltd.

[Spinnability]

Discharge of a polymer during spinning and an obtained nonwoven fabric were observed, and spinnability was evaluated based on criteria below.

A: Absence of fiber dust, production of shots, and clogging of nozzle

B: Presence of any of fiber dust, production of shots, and clogging of nozzle

[Average Fiber Diameter (μm)]

An average fiber diameter was obtained by photographing the nonwoven fabric as being magnified with a scanning electron microscope, measuring diameters of any 100 fibers, and calculating an average value.

[Basis Weight of Nonwoven Fabric (g/m$^2$)]

In compliance with JIS L 1906, 20 cm by 20 cm sample pieces were taken, and the mass of each sample piece was measured with an electronic balance and divided by 400 cm$^2$ which was the area of the sample piece, to obtain a basis weight representing the mass per unit area.

[Thickness of Nonwoven Fabric (μm)]

In compliance with JIS L 1906, the same sample pieces as those used for the measurement of the basis weight were used, and the thickness of each sample piece was measured at five positions with a digital thickness measuring device having a diameter of 16 mm and a load of 20 gf/cm$^2$ (BI type, manufactured by Toyo Seiki Seisaku-Sho, Ltd.). The average value of the thicknesses measured at 15 positions was calculated to determine the thickness of a sheet.

[Density of Nonwoven Fabric (g/Cm$^3$)]

The density of the nonwoven fabric was calculated by dividing [Basis Weight of Nonwoven Fabric (g/m$^2$)] by [Thickness of Nonwoven Fabric (μm)].

[Vertical Strength (Strength in Vertical Direction (Direction of Flow))]

The nonwoven fabric was cut to a width of 15 mm, and with an autograph manufactured by Shimadzu Corporation, the nonwoven fabric was stretched at a tension rate of 10 cm/minute, and a value of a load at the time of tear was measured as a vertical strength (/15 mm), in compliance with JIS L 1906.

[Air Permeability of Nonwoven Fabric (Seconds/100 mL)]

In compliance with JIS L 1906, with an air permeability tester (Gurley type densometer) manufactured by Toyo Seiki Seisaku-Sho, Ltd., the time taken for a pressure cylinder to fall by 100 mL was measured as air permeability.

[Withstand Voltage of Nonwoven Fabric (kV/Mm)]

In compliance with JIS C 2111, the nonwoven fabric was sandwiched between disc-shaped electrodes having a diameter of 25 mm and a mass of 250 g. Air was used as a test medium. An alternating voltage with a frequency of 60 Hz was applied with an increase of 1.0 kV/second, and a voltage at which insulation breakdown occurred was measured. The obtained value was divided by the thickness of the nonwoven fabric and determined as a withstand voltage.

[Flame Retardancy]

A char length at the time when a lower end of a sample arranged at 45° C. was heated for 10 seconds with a Meker burner spaced apart by 50 mm from the lower end of the sample was measured in compliance with the test method defined under JIS A1322. Flame retardancy was evaluated from the result of the char length, based on criteria below.

C: Char length of less than 5 cm

D: Char length of more than or equal to 5 cm

Example 1

Amorphous polyetherimide having a melt viscosity at 330° C. of 500 Pa·s was extruded with an extruder, and was supplied to a melt blown nonwoven fabric manufacturing apparatus having nozzles with a nozzle hole size D (diameter) of 0.3 mm, L (nozzle length)/D of 10, and a nozzle hole pitch of 0.67 mm. Air was blown thereto at a single hole discharge amount of 0.15 g/minute, a spinning temperature of 420° C., a hot air temperature of 430° C., and 15 $Nm^3$/minute per 1 m of nozzle width, to obtain a nonwoven fabric having a basis weight of 25 g/$m^2$. Next, the obtained nonwoven fabric was placed in a hydroentangling machine, and water having a pressure of 2 MPa was injected onto both surfaces of the nonwoven fabric using hydroentangling nozzles with a nozzle hole size (diameter) of 0.1 mm and a hole pitch of 0.6 mm, to three-dimensionally entangle fibers. Then, the nonwoven fabric was dried at 160° C. Further, the obtained nonwoven fabric was passed between a metal roll heated to 200° C. and a resin elastic roll whose surface had a Shore D hardness of 86° (manufactured by Yuri Roll Co., Ltd.), and was pressurized and calendered at a linear pressure of 200 kg/cm. The obtained nonwoven fabric had an average fiber diameter of 2.2 μm, a thickness of 35 μm, a vertical strength of 25 N/15 mm, an air permeability of 22 seconds/100 mL, and a withstand voltage of 23 kV/mm. Thus, an insulating nonwoven fabric having flame retardancy and a high strength was obtained.

Example 2

A nonwoven fabric was obtained with the same method as that in Example 1 except for employing a resin elastic roll whose surface had a Shore D hardness of 90° (manufactured by Yuri Roll Co., Ltd.).

Example 3

A nonwoven fabric was obtained with the same method as that in Example 1 except for employing a resin elastic roll whose surface had a Shore D hardness of 93° (manufactured by Yuri Roll Co., Ltd.).

Example 4

A nonwoven fabric was obtained with the same method as that in Example 1 except for employing a resin elastic roll whose surface had a Shore D hardness of 95° (manufactured by Yuri Roll Co., Ltd.).

Example 5

A nonwoven fabric was obtained with the same method as that in Example 3 except for setting the temperature of the metal roll to 160° C.

Example 6

A nonwoven fabric was obtained with the same method as that in Example 3 except for setting the temperature of the metal roll to 280° C.

Example 7

A nonwoven fabric was obtained with the same method as that in Example 3 except for setting the linear pressure to 150 kg/cm.

Example 8

A nonwoven fabric was obtained with the same method as that in Example 3 except for setting the linear pressure to 450 kg/cm.

Example 9

Amorphous polyetherimide having a melt viscosity at 330° C. of 500 Pa·s was extruded with an extruder, and was supplied to a melt blown nonwoven fabric manufacturing apparatus having nozzles with a nozzle hole size D (diameter) of 0.1 mm, L (nozzle length)/D of 20, and a nozzle hole pitch of 0.67 mm. Air was blown thereto at a single hole discharge amount of 0.05 g/minute, a spinning temperature of 420° C., a hot air temperature of 430° C., and 20 $Nm^3$/minute per 1 m of nozzle width, to obtain a nonwoven fabric having a basis weight of 25 g/$m^2$. Next, the obtained nonwoven fabric was placed in a hydroentangling machine, and water having a pressure of 2 MPa was injected onto both surfaces of the nonwoven fabric using hydroentangling nozzles with a nozzle hole size (diameter) of 0.1 mm and a hole pitch of 0.6 mm, to three-dimensionally entangle fibers. Then, the nonwoven fabric was dried at 160° C. Further, the obtained nonwoven fabric was passed between a metal roll heated to 200° C. and a resin elastic roll whose surface had a Shore D hardness of 93° which was the same as that in Example 3, and was pressurized and calendered at a linear pressure of 200 kg/cm. The obtained nonwoven fabric had an average fiber diameter of 0.7 μm, a thickness of 25 μm, a vertical strength of 34 N/15 mm, an air permeability of 100 seconds/100 mL, and a withstand voltage of 58 kV/mm. Thus, an insulating nonwoven fabric having flame retardancy and a high strength was obtained.

Example 10

Amorphous polyetherimide having a melt viscosity at 330° C. of 2200 Pa·s was extruded with an extruder, and was supplied to a melt blown nonwoven fabric manufacturing apparatus having nozzles with a nozzle hole size D (diameter) of 0.3 mm, L (nozzle length)/D of 10, and a nozzle hole pitch of 0.67 mm. Air was blown thereto at a single hole discharge amount of 0.15 g/minute, a spinning temperature of 455° C., a hot air temperature of 465° C., and 20 $Nm^3$/minute per 1 m of nozzle width, to obtain a nonwoven fabric having a basis weight of 25 g/$m^2$. Next, the obtained nonwoven fabric was placed in a hydroentangling machine, and water having a pressure of 2 MPa was injected onto both surfaces of the nonwoven fabric using hydroentangling nozzles with a nozzle hole size (diameter) of 0.1 mm and a hole pitch of 0.6 mm, to three-dimensionally entangle fibers. Then, the nonwoven fabric was dried at 160° C. Further, the obtained nonwoven fabric was passed between a metal roll heated to 200° C. and a resin elastic roll whose surface had a Shore D hardness of 95°, and was pressurized and calendered at a linear pressure of 200 kg/cm. The obtained nonwoven fabric had an average fiber diameter of 2.7 μm, a thickness of 25 μm, a vertical strength of 22 N/15 mm, an air permeability of 24 seconds/100 mL, and a withstand voltage of 48 kV/mm. Thus, an insulating nonwoven fabric having flame retardancy and a high strength was obtained.

Example 11

A nonwoven fabric was obtained with the same method as that in Example 1 except for employing a metal roll instead of the resin elastic roll and setting the basis weight to 100 g/m$^2$. The obtained nonwoven fabric had an average fiber diameter of 2.2 μm, a thickness of 135 μm, a vertical strength of 96 N/15 mm, an air permeability of 21 seconds/100 mL, and a withstand voltage of 22 kV/mm. Thus, an insulating nonwoven fabric having flame retardancy and a high strength was obtained.

Comparative Example 1

A nonwoven fabric was obtained with the same method as that in Example 1 except for employing a resin elastic roll whose surface had a Shore D hardness of 80°.

Comparative Example 2

A nonwoven fabric was obtained with the same method as that in Example 1 except for employing a metal roll instead of the resin elastic roll.

Comparative Example 3

A nonwoven fabric was obtained with the same method as that in Example 3 except for setting the temperature of the metal roll to 100° C.

Comparative Example 4

Although a nonwoven fabric was calendered with the same method as that in Example 3 except for setting the temperature of the metal roll to 350° C., the nonwoven fabric stuck on a calender roll and was not able to be processed.

Comparative Example 5

A nonwoven fabric was obtained with the same method as that in Example 3 except for setting the linear pressure to 60 kg/cm.

Comparative Example 6

A nonwoven fabric was calendered with the same method as that in Example 3 except for setting the linear pressure to 800 kg/cm. However, since the linear pressure was too high, the nonwoven fabric tore and was not able to be processed.

Comparative Example 7

A nonwoven fabric was obtained with the same method as that in Example 1 except for not performing hydroentangling and using a metal roll instead of the resin elastic roll.

Comparative Example 8

Amorphous polyetherimide having a melt viscosity at 330° C. of 80 Pa·s was extruded with an extruder, and was supplied to a melt blown nonwoven fabric manufacturing apparatus having nozzles with a nozzle hole size D (diameter) of 0.3 mm, L (nozzle length)/D of 10, and a nozzle hole pitch of 0.67 mm. Air was blown thereto at a single hole discharge amount of 0.15 g/minute, a spinning temperature of 420° C., a hot air temperature of 430° C., and 15 Nm$^3$/minute per 1 m of nozzle width, to obtain a nonwoven fabric having a basis weight of 25 g/m$^2$. However, since the melt viscosity was too low, nozzle pressure was not stabilized, and polymer lumps not having the shape of fibers were often generated on a web, resulting in poor spinnability.

Comparative Example 9

Amorphous polyetherimide having a melt viscosity at 330° C. of 3100 Pa·s was extruded with an extruder, and was supplied to a melt blown nonwoven fabric manufacturing apparatus having nozzles with a nozzle hole size D (diameter) of 0.3 mm, L (nozzle length)/D of 10, and a nozzle hole pitch of 0.67 mm. Air was blown thereto at a single hole discharge amount of 0.15 g/minute, a spinning temperature of 435° C., a hot air temperature of 445° C., and 15 Nm$^3$/minute per 1 m of nozzle width, to obtain a nonwoven fabric having a basis weight of 25 g/m$^2$. However, since the melt viscosity was high, the nozzles clogged, resulting in poor spinnability.

Comparative Example 10

Amorphous polyetherimide having a melt viscosity at 330° C. of 500 Pa·s was extruded with an extruder, and was supplied to a melt blown nonwoven fabric manufacturing apparatus having nozzles with a nozzle hole size D (diameter) of 0.1 mm, L (nozzle length)/D of 20, and a nozzle hole pitch of 0.67 mm. Air was blown thereto at a single hole discharge amount of 0.01 g/minute, a spinning temperature of 450° C., a hot air temperature of 460° C., and 25 Nm$^3$/minute per 1 m of nozzle width, to obtain fibers having an average fiber diameter of 0.4 μm. However, fiber dust (thread breakage) was often generated, and it was difficult to obtain a nonwoven fabric.

Comparative Example 11

Multifilaments having a fiber diameter of 15 μm and a dry heat shrinkage at 200° C. of 3.5% were obtained at a spinning temperature of 390° C. from amorphous polyetherimide having a melt viscosity at 330° C. of 900 Pa·s. The obtained multifilaments were crimped, followed by cutting. Then, short fibers having a fiber length of 51 mm were fabricated and subjected to a card to thereby fabricate a fiber web having a basis weight of 28 g/m$^2$. This web was placed on a support net of a hydroentangling machine, and staples were entangled and integrated with one another by injecting water at a pressure of 20 to 100 kgf7 cm$^2$ onto both surfaces. Thereafter, dry heat treatment at a temperature of 110 to 160° C. was performed to obtain a nonwoven fabric. Further, the obtained nonwoven fabric was passed between a metal roll heated to 200° C. and a resin elastic roll whose surface had a Shore D hardness of 93°, and was pressurized and calendered at a linear pressure of 200 kg/cm. The obtained nonwoven fabric had an average fiber diameter of 15 μm, a thickness of 35 μm, a vertical strength of 15 N/15 mm, and had flame retardancy. However, the obtained nonwoven fabric had a thick fiber diameter, low denseness, a low air permeability of 0 seconds/100 mL, and a low withstand voltage of 1 kV/mm.

Table 1 shows results of Examples 1 to 11, and Table 2 shows results of Comparative Examples 1 to 9 and 11.

TABLE 1

| | Example 1 | Example 2 | Example 3 | Example 4 | Example 5 | Example 6 |
|---|---|---|---|---|---|---|
| Melt Viscosity (Pa · s @330° C.) | 500 | 500 | 500 | 500 | 500 | 500 |
| Spinning Temperature (° C.) | 420 | 420 | 420 | 420 | 420 | 420 |
| Spinning Method | Melt Blown | Melt Blown | Melt Blown | Melt Blown | Melt Blown | Melt Blown |
| Spinnability | A | A | A | A | A | A |
| Spun Lace Entangling | Performed | Performed | Performed | Performed | Performed | Performed |
| Calendering Temperature (° C.) | 200 | 200 | 200 | 200 | 160 | 280 |
| Linear Pressure (kg/cm) | 200 | 200 | 200 | 200 | 200 | 200 |
| Shore D Hardness of Elastic Roll Surface (°) | 86 | 90 | 93 | 95 | 93 | 93 |
| Average Fiber Diameter (μm) | 2.2 | 2.2 | 2.2 | 2.2 | 2.2 | 2.2 |
| Basis Weight of Nonwoven Fabric (g/m$^2$) | 25 | 25 | 25 | 25 | 25 | 25 |
| Thickness of Nonwoven Fabric (μm) | 35 | 32 | 30 | 25 | 35 | 28 |
| Density of Nonwoven Fabric (g/cm$^3$) | 0.71 | 0.78 | 0.83 | 1.00 | 0.71 | 0.89 |
| Vertical Strength (N/15 mm) | 25 | 23 | 25 | 26 | 20 | 24 |
| Air Permeability (seconds/100 mL) | 22 | 29 | 35 | 40 | 21 | 36 |
| Withstand Voltage (kv/mm) | 23 | 31 | 40 | 60 | 18 | 42 |
| Flame Retardancy | C | C | C | C | C | C |

| | Example 7 | Example 8 | Example 9 | Example 10 | Example 11 |
|---|---|---|---|---|---|
| Melt Viscosity (Pa · s @330° C.) | 500 | 500 | 500 | 2200 | 500 |
| Spinning Temperature (° C.) | 420 | 420 | 420 | 455 | 420 |
| Spinning Method | Melt Blown | Melt Blown | Melt Blown | Melt Blown | Melt Blown |
| Spinnability | A | A | A | A | A |
| Spun Lace Entangling | Performed | Performed | Performed | Performed | Performed |
| Calendering Temperature (° C.) | 200 | 200 | 200 | 200 | 200 |
| Linear Pressure (kg/cm) | 150 | 450 | 200 | 200 | 200 |
| Shore D Hardness of Elastic Roll Surface (°) | 93 | 93 | 93 | 95 | metal/metal |
| Average Fiber Diameter (μm) | 2.2 | 2.2 | 0.7 | 2.7 | 2.7 |
| Basis Weight of Nonwoven Fabric (g/m$^2$) | 25 | 25 | 25 | 25 | 100 |
| Thickness of Nonwoven Fabric (μm) | 36 | 21 | 25 | 25 | 135 |
| Density of Nonwoven Fabric (g/cm$^3$) | 0.69 | 1.19 | 1.00 | 1.00 | 0.74 |
| Vertical Strength (N/15 mm) | 24 | 24 | 34 | 22 | 96 |
| Air Permeability (seconds/100 mL) | 21 | 45 | 100 | 24 | 21 |
| Withstand Voltage (kv/mm) | 18 | 61 | 58 | 48 | 22 |
| Flame Retardancy | C | C | C | C | C |

TABLE 2

| | Comparative Example 1 | Comparative Example 2 | Comparative Example 3 | Comparative Example 4 | Comparative Example 5 | Comparative Example 6 |
|---|---|---|---|---|---|---|
| Melt Viscosity (Pa · s @330° C.) | 500 | 500 | 500 | 500 | 500 | 500 |
| Spinning Temperature (° C.) | 420 | 420 | 420 | 420 | 420 | 420 |
| Spinning Method | Melt Blown | Melt Blown | Melt Blown | Melt Blown | Melt Blown | Melt Blown |
| Spinnability | A | A | A | A | A | A |
| Spun Lace Entangling | Performed | Performed | Performed | Performed | Performed | Performed |
| Calendering Temperature (° C.) | 200 | 200 | 100 | 350 | 100 | 100 |
| Linear Pressure (kg/cm) | 200 | 200 | 200 | 200 | 60 | 800 |
| Shore D Hardness of Elastic Roll Surface (°) | 80 | metal/metal | 93 | 93 | 93 | 93 |
| Average Fiber Diameter (μm) | 2.2 | 2.2 | 2.2 | 2.2 | 2.2 | 2.2 |
| Basis Weight of Nonwoven Fabric (g/m$^2$) | 25 | 25 | 25 | 25 | 25 | 25 |
| Thickness of Nonwoven Fabric (μm) | 40 | 22 | 42 | — | 45 | — |
| Density of Nonwoven Fabric (g/cm$^3$) | 0.63 | 1.14 | 0.60 | — | 0.56 | — |
| Vertical Strength (N/15 mm) | 20 | 24 | 20 | — | 20 | — |
| Air Permeability (seconds/100 mL) | 1 | 9 | 1 | — | 1 | — |
| Withstand Voltage (kv/mm) | 10 | 11 | 8 | — | 7 | — |
| Flame Retardancy | C | C | C | — | C | — |

| | Comparative Example 7 | Comparative Example 8 | Comparative Example 9 | Comparative Example 11 |
|---|---|---|---|---|
| Melt Viscosity (Pa · s @330° C.) | 500 | 80 | 3100 | 900 |
| Spinning Temperature (° C.) | 420 | 420 | 435 | 390 |
| Spinning Method | Melt Blown | Melt Blown | Melt Blown | Filament |

TABLE 2-continued

| | | | | | |
|---|---|---|---|---|---|
| Spinnability | | A | B | B | A |
| Spun Lace Entangling | | Not Performed | Not Performed | Not Performed | Performed |
| Calendering | Temperature (° C.) | 200 | 200 | 200 | 200 |
| | Linear Pressure (kg/cm) | 200 | 100 | 100 | 200 |
| | Shore D Hardness of Elastic Roll Surface (°) | metal/metal | metal/metal | metal/metal | 93 |
| Average Fiber Diameter (μm) | | 2.2 | 8.2 | 21 | 15 |
| Basis Weight of Nonwoven Fabric ($g/m^2$) | | 25 | 25 | 25 | 28 |
| Thickness of Nonwoven Fabric (μm) | | 30 | 42 | 61 | 35 |
| Density of Nonwoven Fabric ($g/cm^3$) | | 0.83 | 0.60 | 0.41 | 0.80 |
| Vertical Strength (N/15 mm) | | 7 | 3 | 5 | 15 |
| Air Permeability (seconds/100 mL) | | 0 | 0 | 0 | 0 |
| Withstand Voltage (kv/mm) | | 8 | 6 | 1 | 1 |
| Flame Retardancy | | C | C | c | C |

The invention claimed is:

1. A nonwoven fabric, comprising an amorphous polyetherimide having a melt viscosity at 330° C. of 100 to 3000 Pa·s, and satisfying conditions of:

1) an average fiber diameter of 0.5 to 5 μm;

2) an air permeability of at least 20 seconds/100 mL; and 3) a withstand voltage of at least 20 kV/mm.

2. The nonwoven fabric according to claim 1, wherein the nonwoven fabric has a vertical strength of at least 15 N/15 mm.

3. The nonwoven fabric according to claim 1, wherein the nonwoven fabric has a density within a range of 0.65 to 1.25 $g/cm^3$.

4. An insulating material comprising the nonwoven fabric according to claim 1.

5. A method for manufacturing the nonwoven fabric according to claim 1, comprising continuously treating fibers between rolls arranged to face each other, at a temperature of 150 to 300° C. and a linear pressure of 100 to 500 kg/cm.

6. The method for manufacturing the nonwoven fabric according to claim 5, wherein the rolls arranged to face each other are an elastic roll whose surface has a Shore D hardness of 85 to 95° and a metal roll.

7. The method for manufacturing the nonwoven fabric according to claim 5, wherein the continuously treated fibers are manufactured with a melt blown method or a spunbond method.

* * * * *